US005333654A

United States Patent [19]

Faeth

[11] Patent Number: 5,333,654

[45] **Date of Patent: * Aug. 2, 1994**

[54] VAPOR PASSAGE FUEL BLOCKAGE REMOVAL

[75] Inventor: Warren P. Faeth, Fort Wayne, Ind.

[73] Assignee: Tokheim Corporation, Fort Wayne, Ind.

[ * ] Notice: The portion of the term of this patent subsequent to Jun. 7, 2005 has been disclaimed.

[21] Appl. No.: 83,358

[22] Filed: Jun. 28, 1993

Related U.S. Application Data

[60] Division of Ser. No. 893,226, Jun. 3, 1992, Pat. No. 5,240,045, which is a division of Ser. No. 704,332, May 23, 1991, Pat. No. 5,129,433, which is a division of Ser. No. 531,041, May 31, 1990, Pat. No. 5,040,576, which is a division of Ser. No. 330,149, Mar. 29, 1989, Pat. No. 4,967,809, which is a division of Ser. No. 98,453, Sep. 18, 1987, Pat. No. 4,842,027, which is a division of Ser. No. 113,372, Oct. 23, 1987, Pat. No. 4,749,009, which is a continuation of Ser. No. 803,152, Dec. 2, 1985, abandoned.

[51] Int. Cl.[5] ..... B67D 5/06

[52] U.S. Cl. ..... 141/1; 141/44; 141/46; 141/59; 141/302

[58] Field of Search ..... 141/44–49, 141/59, 302, 1

[56] References Cited

U.S. PATENT DOCUMENTS

| | | | |
|---|---|---|---|
| 2,307,085 | 1/1943 | Trexler . | |
| 2,540,064 | 1/1951 | Weber . | |
| 2,785,546 | 4/1957 | Bauerlein . | |
| 2,969,748 | 1/1961 | Staats et al. . | |
| 3,338,173 | 8/1967 | Gunzel, Jr. et al. . | |
| 3,850,208 | 11/1974 | Hamilton . | |
| 3,863,687 | 2/1975 | Alquist . | |
| 3,905,405 | 9/1975 | Fowler et al. . | |
| 3,913,633 | 10/1975 | Hiller . | |
| 3,915,206 | 10/1975 | Fowler et al. . | |
| 3,952,781 | 4/1976 | Hiller et al. . | |
| 3,981,334 | 9/1976 | Deters . | |
| 3,981,335 | 9/1976 | Deters . | |
| 4,009,739 | 4/1977 | Weatherford . | |
| 4,033,706 | 7/1977 | Schaefer et al. . | |
| 4,057,085 | 11/1977 | Shihabi . | |
| 4,057,086 | 11/1977 | Healy . | |
| 4,068,687 | 1/1978 | Long . | |
| 4,072,934 | 2/1978 | Hiller et al. . | |
| 4,095,626 | 6/1978 | Healy . | |
| 4,167,957 | 9/1979 | Voelz et al. . | |
| 4,167,958 | 9/1979 | Voelz . | |
| 4,253,503 | 3/1981 | Gunn . | |
| 4,263,498 | 4/1981 | Meyers . | |
| 4,310,033 | 1/1982 | Deters . | |
| 4,336,830 | 6/1982 | Healy . | |
| 4,395,201 | 7/1983 | Bron . | |
| 4,396,356 | 8/1983 | Thompson . | |
| 4,566,504 | 1/1986 | Furrow . | |
| 4,570,686 | 2/1986 | Devine . | |
| 4,595,344 | 6/1986 | Briley . | |
| 4,687,033 | 8/1987 | Furrow et al. | 141/59 |
| 4,749,009 | 6/1988 | Faeth | 141/45 |
| 4,827,987 | 5/1989 | Faeth | 141/59 |

(List continued on next page.)

FOREIGN PATENT DOCUMENTS

| | | | |
|---|---|---|---|
| 0155186 | 9/1985 | European Pat. Off. | 141/45 |
| 915131 | 9/1945 | France . | |
| 2016417 | 4/1979 | United Kingdom . | |

*Primary Examiner*—Ernest G. Cusick
*Attorney, Agent, or Firm*—Baker & Daniels

[57] ABSTRACT

A device for mounting in a fuel dispensing hose that has a flexible inner tube defining the fuel conduit, and a tubular outer sleeve that defines with the inner tube an annular vapor return passage. The device includes a venturi section adapted for serial connection with the inner tube within the outer sleeve. The section comprises a cylindrical block that connects at each end with an end of the inner tube and defines a venturi forming part of the fuel conduit. The block also has an aspirator means that defines at least two radial ports communicating between the venturi throat and the annular vapor passage. Each radial port has a check valve to block fuel flow from the fuel conduit to the vapor passage.

4 Claims, 2 Drawing Sheets

U.S. PATENT DOCUMENTS 4,842,027 6/1989 Faeth ..... 141/45
4,951,720 8/1990 Grantham .
4,967,809 11/1990 Faeth ..... 141/59
5,005,613 4/1991 Stanley ..... 141/45
5,040,576 8/1991 Faeth ..... 141/45
5,040,577 8/1991 Pope .
5,042,537 8/1991 Grantham ..... 141/59
5,056,569 10/1991 Walker et al. ..... 141/44
5,082,027 1/1992 Stanley ..... 138/113
5,088,528 2/1992 Grantham ..... 141/44
5,102,012 4/1992 Foster ..... 141/44 X
5,129,433 7/1992 Faeth ..... 141/45
5,148,840 9/1992 Grantham ..... 141/44
5,240,045 8/1993 Faeth ..... 141/1

FIG. 1
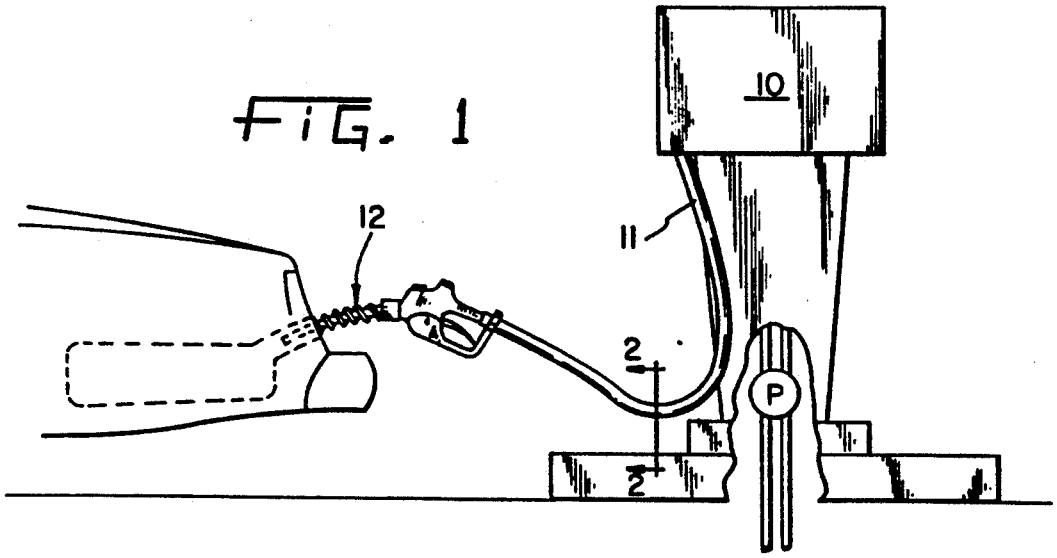
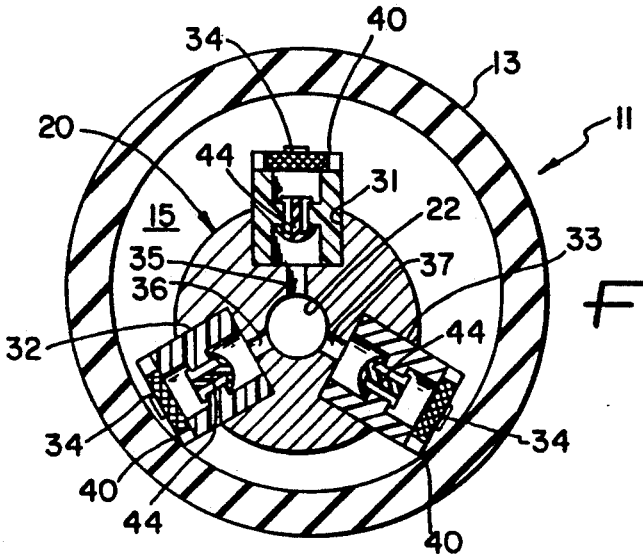
FIG. 2
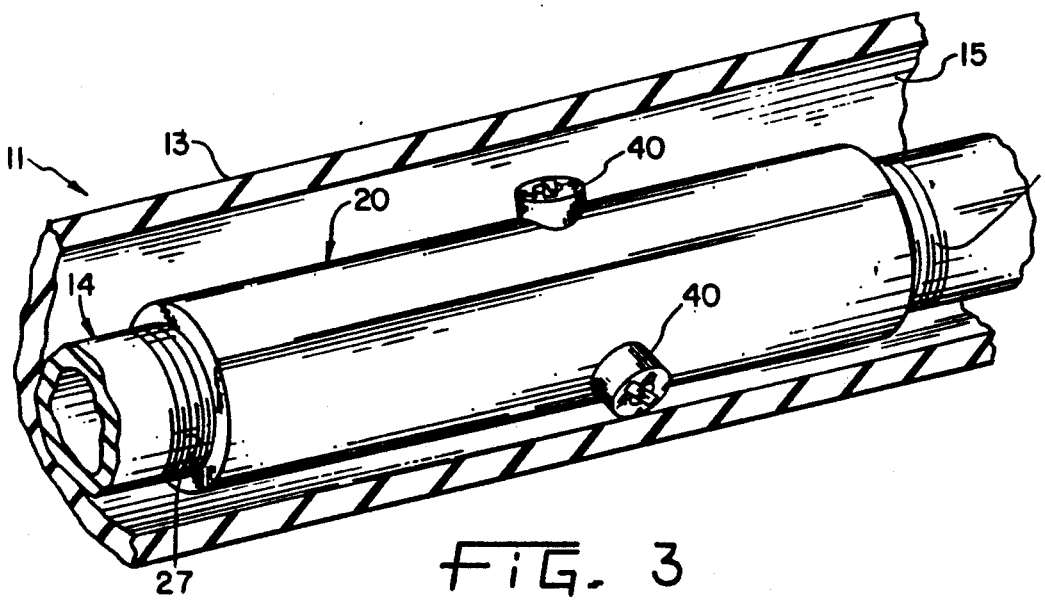
FIG. 3

VAPOR PASSAGE FUEL BLOCKAGE REMOVAL

This is a division of application Ser. No. 07/893,226, filed Jun. 3, 1992 now U.S. Pat. No. 5,240,045, which is a division of U.S. patent application Ser. No. 07/704,332, filed on May 23, 1991 now U.S. Pat. No. 5,129,433, which is a division of U.S. Ser. No. 07/531,041, filed May 31, 1990, U.S. Pat. No. 5,040,576, issued Aug. 20, 1991, which is a division of U.S. Ser. No. 07/330,149, filed Mar. 29, 1989, U.S. Pat. No. 4,967,809 issued Nov. 6, 1990, which is a division of U.S. Ser. No. 07/098,453, filed Sep. 18, 1987, U.S. Pat. No. 4,842,027, issued Jun. 27, 1989, which is a division of U.S. Ser. No. 07/113,372 filed Oct. 23, 1987, U.S. Pat. No. 4,749,009, issued Jun. 7, 1988, which is a continuation of U.S. patent application Ser. No. 803,152, filed Dec. 2, 1985, now abandoned.

This invention relates to liquid fuel dispensing equipment for automotive service stations or the like where liquid fuel such as gasoline is dispensed from fuel storage tanks to automotive vehicles or, in some instances, to small fuel containers; and it especially relates to vapor recovery systems for such equipment, which prevent the escape of hydrocarbon vapors to the atmosphere during the refueling process by drawing the vapors through a vapor return line associated with a flexible fuel hose.

More particularly, the invention relates to a device for removing liquid fuel resulting from condensation or splashback, for example, that may block the vapor return line.

Most liquid fuel dispensing equipment includes a pump connected to a fuel reservoir, a valved nozzle adapted to be inserted in the fill pipe of a vehicle fuel tank, and a flexible fuel hose connected between the pump outlet pipe and the valve nozzle. The apparatus also includes, in most cases, a vapor recovery system for preventing the escape of hydrocarbon vapors to the atmosphere.

Previous vapor recovery systems have included passages in the valved nozzle for collecting vapors from the vehicle fuel tank, and a vapor return line integral with the flexible fuel hose for delivering the vapors back to the fuel reservoir. Some systems use a vacuum pump for drawing vapors through the return line and others rely on vapor pressure in the fuel tank. Often, the return line is defined by the inner wall of an outer hose or sleeve and the outer surface of a smaller diameter flexible inner hose which constitutes the liquid fuel conduit.

The vapor return line, however, frequently becomes blocked with liquid fuel due to condensation of fuel vapors and/or splashback that occurs during the refueling operation. As a result, the vapor recovery system fails and hydrocarbon vapors escape to the atmosphere. Usually, the liquid fuel collects in the lowest portion of the flexible fuel hose, such as in a loop that forms between the ends.

One solution to this problem is a system wherein a suction tube is positioned in the vapor return passage (i.e., the passage defined by the inner wall of the flexible outer sleeve and the outer wall of the fuel tube), with one end that extends to the approximate low point in the conduit where liquid fuel collects. The other end of the suction tube extends to a suction-producing device integral with the nozzle.

The suction-producing device may include, for example, a venturi block connected in series with the liquid fuel conduit through which the fuel passes into the valved nozzle. The block defines a venturi throat and the other end of the suction tube is connected to a radial passage extending through the wall of the block to the venturi throat so that the pressure drop in the throat produces a suction in the tube. Accordingly, the collected liquid fuel is drawn through the suction tube into the venturi throat and dispensed through the nozzle with the normal fuel flow.

One disadvantage of this device, however, is that the suction tube is vulnerable to blockage by small particles within the fuel hose. Also, backflow may occur when the flow of liquid fuel through the venturi is shut off.

The device of the present invention resolves many of the difficulties and disadvantages described above and affords other features and advantages heretofore not obtainable.

SUMMARY OF THE INVENTION

It is among the objects of the present invention to minimize the escape of hydrocarbon vapors to the atmosphere during vehicle fueling operations.

Another object is to remove liquid fuel that pools in a vapor return line of a flexible fuel hose as a result of condensation or splashback.

Still another object is to provide an improved device for removing blockage from the vapor return line of a liquid fuel dispensing hose.

These and other objects and advantages are achieved by the unique device of the present invention, which is adapted to be inserted in a liquid fuel dispensing hose of the coaxial type that includes an inner tube defining a fuel conduit and a tubular outer sleeve that defines, with the outer surface of the inner tube, a generally annular passage for removing fuel vapors from the vehicle fuel tank. The device includes a venturi section adapted for insertion in series with the inner tube within the outer sleeve. The venturi section comprises a rigid, cylindrical block defining axial connecting means at each end for connection to end portions of the inner tube. The block also defines a venturi throat communicating at opposite ends with the connected ends of the inner tube.

At least three radially extending aspirator elements are mounted on the block and extend radially through the venturi section at uniformly spaced radial locations in a transverse plane that intersects the block at approximately the throat of the venturi. Each aspirator block defines a radial port communicating between the venturi throat and the annular vapor passage. A check valve is associated with each aspirator element to block backflow of fuel from the fuel conduit whenever fuel flow is stopped. Accordingly, liquid fuel that condenses or collects in the annular vapor passage adjacent the venturi block will be sucked through at least one f the aspirator blocks due to the suction produced in the venturi throat.

BRIEF DESCRIPTION OF THE DRAWINGS

FIG. 1 is a diagrammatic view illustrating a typical fuel dispensing installation that includes a flexible fuel hose for use in an automotive vehicle service station;

FIG. 2 is a transverse sectional view on an enlarged scale, taken on the line 2—2 of FIG. 1, and illustrating a device embodying the invention;

FIG. 3 is a fragmentary, perspective view on an enlarged scale of the fuel hose of FIG. 1, with parts broken away for the purpose of illustration;

DESCRIPTION OF THE PREFERRED EMBODIMENT

Figure 4:
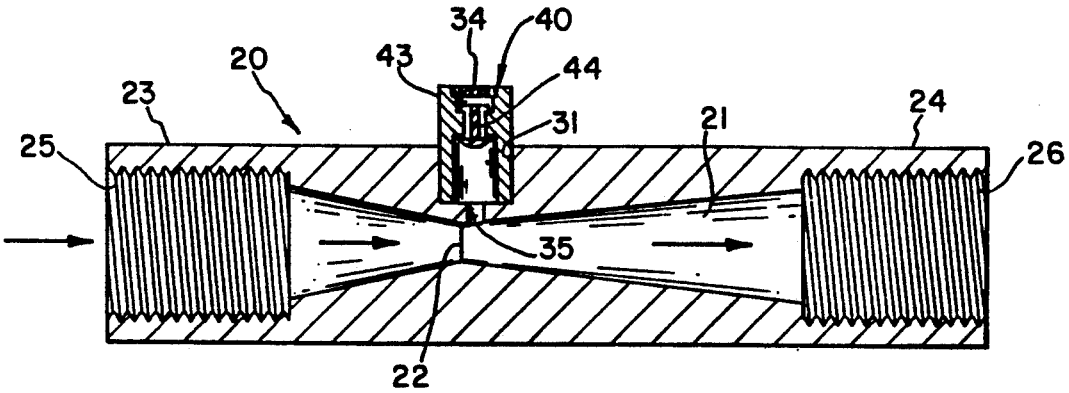
FIG. 4 is a longitudinal, sectional view through the venturi section illustrated in FIGS. 2 and 3.

Referring more particularly to the drawings, and initially to FIG. 1, there is shown a fuel dispensing installation for an automotive vehicle service station. The installation includes a metering console 10 in which a pump P is located. The outlet pipe of the pump usually extends to the front or side of the console 10, where it connects to a flexible fuel hose 11, which in turn is connected to a valved nozzle 12. The valved nozzle 12 may be grasped by an operator and inserted into the fill pipe of the automotive vehicle to be serviced. The flexible fuel hose 11 is generally formed of reinforced rubber and, in a typical installation, may be about 8 to 14 feet long.

The fuel hose 11 is adapted to be moved from a storage position to an extended position along with the valved nozzle 12 so that the hose and nozzle can be extended to a variety of positions for connection to the fuel tank of an automotive vehicle located within the range of extension of the nozzle 12 and hose 11.

Referring to FIGS. 2 and 3, the flexible fuel hose 11 includes a flexible inner fuel tube 14 through which the liquid fuel is transmitted, and an outer annular sleeve 13. The inner surface of the outer sleeve 13 and the outer surface of the fuel tube 14 define an annular vapor return passage 15 through which fuel vapors are returned from the vehicle fuel tank to the fuel reservoir.

As illustrated in FIG. 1, the flexible fuel hose 11 usually has a looped portion in which the lowest portion 16 of the hose occurs. Accordingly, any condensation which forms in the annular vapor return passage 15, or any fuel which enters the passage 15 due to splashback from the liquid fuel being dispensed into the fuel tank, collects or pools in the low zone 16. If enough liquid fuel accumulates, it will be apparent that blockage of the vapor return passage 15 will occur and vapor will be unable to pass back to the fuel reservoir. As a result, hydrocarbon vapors will escape to atmosphere and the purpose of the vapor recovery system will be defeated.

In accordance with the invention, the liquid fuel that accumulates at the low portion 16 of the flexible fuel hose 11 is removed by means of a cylindrical venturi block 20 which is positioned within the outer sleeve 13 at approximately the low point of the hose and in series with the inner fuel tube 14. The venturi block 20 has a generally tubular form that defines a venturi 21 with a throat portion 22. Each end 23 and 24 of the block 20 is provided with a threaded socket 25 and 26, respectively, adapted to receive a threaded end portion 27, 28 of the inner tube 14, so that the venturi 21 merely constitutes a continuation of the passage through which liquid fuel flows from the pump to the valved nozzle 12.

As indicated in FIG. 1, the venturi block 20 is ideally positioned about 36 inches upstream from the valved nozzle 12. That is typically the location of the lowest portion of the flexible fuel hose 11 during vehicle fueling operations.

Figure 5:
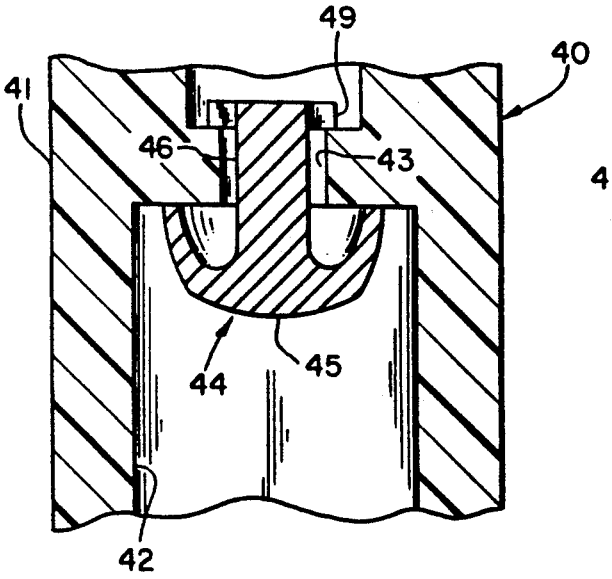
FIG. 5 is a sectional view on an enlarged scale illustrating one of the three aspirator devices shown in FIGS. 2, 3, and 4.
Figure 6:
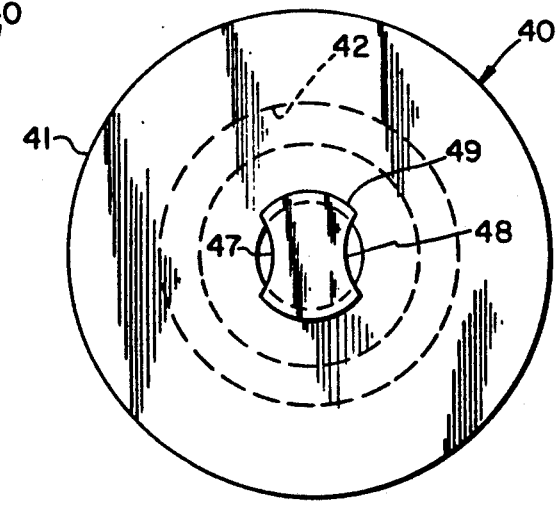
FIG. 6 is a plan view of the aspirator device of FIG. 5.

The cylindrical venturi block 20 is provided with three radial bores or seats 31, 32, 33 uniformly spaced about the circumference thereof in a plane generally intersecting the throat 22 of the venturi 21. Each of these bores or seats 31, 32, and 33 have a concentric port 35, 36, 37 that extends from the base of the seat through to the venturi throat 22. Each of the seats 31, 32, and 33 has a check valve 40 seated therein of the type generally shown in FIGS. 5 and 6, and a filter 34. The valves 40 are of the type generally referred to as "umbrella valves" and they include a main body 41 with open-ended valve chamber 42 formed therein and a central bore 43 extending therethrough. Mounted in the central bore 43 is an elastomeric element 44 with an enlarged head portion 45 located in the chamber 42 and a stem 46 which extends through the central bore 43. The stem 46 has relieved side wall portions 47 and 48 that define, with the bore 43, passages extending between the outer face of the valve body and the valve chamber 42. The valve stem 46 is locked in place by means of an enlarged flanged portion 49.

The purpose of the valve 40 is to permit flow of liquid through the valve from the vapor return passage to the venturi throat 22, but to block reverse flow therethrough.

During a refueling operation when the valved nozzle 12 is inserted into the fill pipe of a vehicle fuel tank, the operator operates the nozzle so that flow of liquid fuel through the hose 11 and valved nozzle 12 is commenced. As the liquid fuel flows through the venturi 21, an increase in velocity occurs, accompanied by a reduction in pressure. The pressure drop thus produced serves to open the umbrella valves 40 and.draw into the flow any liquid fuel that has accumulated in the low portion 16 of the vapor return passage.

Because there are three umbrella valves 40 uniformly spaced about the circumference of the venturi block 20, at least one of the valves will be immersed in any accumulation of liquid fuel. Accordingly, the flow is effective to remove the accumulated liquid fuel so that the vapor return passage is maintained in an open condition and blockage is avoided. The venturi block 20 is generally formed of anodized aluminum so as to be unaffected by the contaminants that would otherwise corrode the material. The umbrella valves 40 are generally formed of a plastic material that can be inserted in the bores or seats formed in the venturi block 20. While the device shown has three umbrella valves 40, it will be apparent that more valves may be used if desired, although at least two valves should be provided for best results.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. In a method of making a hose assembly for dispensing fuel to a nozzle which is adapted to be inserted into the fill pipe of a vehicle fuel tank, said hose assembly comprising an inner tube means having opposed outer ends and defining a fuel conduit and a tubular outer sleeve means having opposed outer ends which defines with said inner tube means an annular passage for recovering fuel vapors from said fuel tank, the improvement comprising the steps of forming said inner tube means to comprise two inner tube sections having flexible portions and having adjacent ends, disposing said inner tube sections so as to respectively have passages therethrough leading from said adjacent ends thereof toward said opposed outer ends of said inner tube means, forming said inner tube means to also comprise a venturi means disposed intermediate said inner tube sections within said outer sleeve means and including passage means therein respectively connected to said passages of said inner tube sections, and forming said venturi means to have inlet means which communicates with said annular vapor passage so that liquid fuel collected in said annular vapor passage is adapted to be drawn through said inlet means due to suction adapted to be produced in said venturi means upon the flow of fuel through said inner tube means.

2. A method of making a hose assembly as set forth in claim 1 wherein said hose assembly is adapted to form a looped low portion when said hose assembly is interconnected to a dispenser pump and is dispensing fuel into a fuel tank and including the step of forming said inner hose means so that said venturi means is adapted to be disposed in said looped low portion when said hose assembly is dispensing said fuel.

3. In a hose assembly for dispensing fuel to a nozzle which is adapted to be inserted into the fill pipe of a vehicle fuel tank, said hose assembly comprising an inner tube means having opposed outer ends and defining a fuel conduit and a tubular outer sleeve means having opposed outer ends which defines with said inner tube means an annular passage for recovering fuel vapors from said fuel tank, the improvement wherein said inner tube means comprises two inner tube sections having flexible portions and having adjacent ends, said inner tube sections respectively having passages therethrough and leading from said adjacent ends thereof toward said opposed outer ends of said inner tube means, said inner tube means also comprising a venturi means disposed intermediate said inner tube sections within said outer sleeve means and including passage means therein respectively connected to said passages of said inner tube sections, said venturi means having inlet means which communicates with said annular vapor passage so that liquid fuel collected in said annular vapor passage is adapted to be drawn through said inlet means due to suction adapted to be produced in said venturi means upon the flow of fuel through said inner tube means.

4. A hose assembly as set forth in claim 3 wherein said hose assembly is adapted to form a looped low portion when said hose assembly is interconnected to a dispenser pump and is dispensing fuel into a fuel tank and wherein said venturi means is located in said inner tube means so as to be disposed in said looped low portion when said hose assembly is dispensing said fuel.

* * * * *